US007679590B2

(12) United States Patent
Wu et al.

(10) Patent No.: US 7,679,590 B2
(45) Date of Patent: Mar. 16, 2010

(54) FIELD SEQUENTIAL LCD DRIVING METHOD

(75) Inventors: Chao-Hui Wu, Taoyuan Hsien (TW); Po-Sheng Shih, Iao-Yuan Hsien (TW); Sweehan Jui-Hsien Yang, Iao-Yuan Hsien (TW)

(73) Assignee: HannStar Display Corporation, Tao-Yuan Hsien (TW)

( * ) Notice: Subject to any disclaimer, the term of this patent is extended or adjusted under 35 U.S.C. 154(b) by 799 days.

(21) Appl. No.: 11/508,973

(22) Filed: Aug. 24, 2006

(65) Prior Publication Data

US 2008/0048962 A1 Feb. 28, 2008

(51) Int. Cl.
*G09G 3/36* (2006.01)

(52) U.S. Cl. ..... 345/88; 345/87; 345/94; 345/98; 345/204

(58) Field of Classification Search ..... 345/87, 345/88, 94, 98, 204
See application file for complete search history.

(56) References Cited

U.S. PATENT DOCUMENTS

| | | | | |
|---|---|---|---|---|
| 2004/0183792 | A1 * | 9/2004 | Takada et al. | 345/204 |
| 2004/0196415 | A1 * | 10/2004 | Kimura et al. | 349/96 |
| 2006/0221031 | A1 * | 10/2006 | Chang et al. | 345/89 |
| 2007/0057904 | A1 * | 3/2007 | Huang et al. | 345/103 |
| 2007/0075945 | A1 * | 4/2007 | Shen et al. | 345/87 |

* cited by examiner

*Primary Examiner*—Richard Hjerpe
*Assistant Examiner*—Saifeldin Elnafia
(74) *Attorney, Agent, or Firm*—Muncy, Geissler, Olds & Lowe, PLLC

(57) ABSTRACT

A field sequential driving method for driving a liquid crystal display, wherein said liquid crystal includes a plurality of gate lines, comprising the steps of: grouping said gate lines into a plurality of zone, including a first zone to an Nth zone; sequentially addressing the first zone to the $N^{th}$ zone, wherein addresses each zone comprising: writing black signals into pixels in the zone; writing white signals into pixels in the zone after the black signals are written into pixels in the zone; sequentially writing color signals to corresponding pixel in the zone; and sequentially flashing light source from the first zone to the $N^{th}$ zone.

11 Claims, 7 Drawing Sheets

| Tr =2.8 ms | Tf =0.6 ms | Tr+Tf =3.4 ms |
|---|---|---|

| Tr' =2.5 ms | Tf' =0.5 ms | Tr' +Tf' =3 ms |
|---|---|---|

FIELD SEQUENTIAL LCD DRIVING METHOD

BACKGROUND

1. Field of Invention

The present invention relates to a liquid crystal display (LCD) driving method. More particularly, the present invention relates to a field sequential LCD driving method.

2. Description of Related Art

Generally, methods for driving an LCD can be classified into two methods, the color filter method and the field sequential driving method, based on methods of displaying color images.

The field sequential liquid crystal display (FS-LCD) driving method has been developed where three color signals, i.e., a red signal, a green signal and a blue signal are time-divisionally displayed. The FS-LCD allows red (R), green (G), and blue (B) backlights to be arranged in one pixel that is not divided into R, G, and B subpixels, wherein light of the three primary colors is provided from the R, G, and B backlights to one pixel through the liquid crystal (LC) so that they are sequentially displayed in a time division manner.

As shown in FIG. 1, in the conventional FS-LCD, the driving scheme of each subframe has three intervals: first, the addressing interval 101 for data being written into the subframe, second, the waiting interval 102 for the response time of the liquid crystal, and the last, the flashing interval 103 for turning on the backlight. Referring to FIG. 2, the backlight emits a flashing interval 103 in the last short period of the subframe after the addressing interval 101 and the waiting interval 102, so it is difficult to achieve high luminance if the flashing interval is too short, i.e. the addressing interval 101 and the waiting interval 102 are too long. Furthermore, since the conventional FS-LCD needs sufficient scanning speeds due to the heavy load of the electrode and low mobility of the TFT in a panel, FS driving can hardly be applied to large area, high density displays. Thus, the conventional driving scheme has a limited resolution, so it isn't appropriate for the implementation of large size FS-LCD.

For the forgoing reasons, there is a need to extend the flashing interval, i.e., decrease the data writing time and the LC response time, and increase the time the backlight is turned on. Furthermore, there is another need for higher and uniform luminance no matter how large the LCD is.

SUMMARY

The present invention is directed to a field sequential driving method for driving a liquid crystal display that satisfies the need for gaining a longer flashing interval to increase the time the backlight is turned on.

The field sequential driving method for driving a liquid crystal display comprises the steps of: dividing a plurality of gate lines and driving a plurality of pixels into a first pixel zone and a second pixel zone□writing first black signals into the first pixel zone; writing first white signals into the first pixel zone after the black signals into the first pixel zone; sequentially writing color signals corresponding to each pixel only in the first pixel zone, driven by each gate line respectively; writing second black signals into in the second pixel zone after color signals are written; writing second white signals into the second pixel zone after second black signals are written; sequentially writing color signals corresponding to each pixel only in the second pixel zone, driven by each gate line respectively; sequentially and periodically turning on a plurality of independent first light sources in the first pixel zone; and sequentially and periodically turning on a plurality of independent second light sources in the second pixel zone.

Furthermore, first white signals and second white signals respectively decrease the voltages of the liquid crystal cells from a splay into a bend state. And each one of the pixels has a liquid crystal cell and a switching element, and the switching element turns each individual pixel on or off hence controlling the response time of the liquid crystal cell. The switching element can be a thin-film transistor and the liquid crystal cell can be in an optical compensated bend mode.

Because signals are written into pixels from one zone to another zone successively, the method needn't scan all gates lines completely and then process the next step of waiting for the liquid crystal response time. Thus, the method can write signals in the next pixel zone immediately after the signals of one zone are written completely, so the method can reduce the addressing time, and then prolong the waiting interval or flashing interval in the subframe.

Moreover, writing first black signals and second black signals into the respective pixels in the period of the subframe, they are taken as reset signals to compensate luminance of the liquid crystal display. Otherwise, writing first black signals and second black signals can decrease the respective voltages of the liquid crystal cells from a splay into a bend state, thus the operating voltage can decrease.

In conclusion, the method can have a longer flashing interval, and thus achieve higher and more uniform luminance. Otherwise, because the voltages of the liquid crystal cells from a splay state into a bend state are reduced, the method can lessen the operating voltage, and the load of the electrode and low mobility of the TFT in a panel can be improved.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
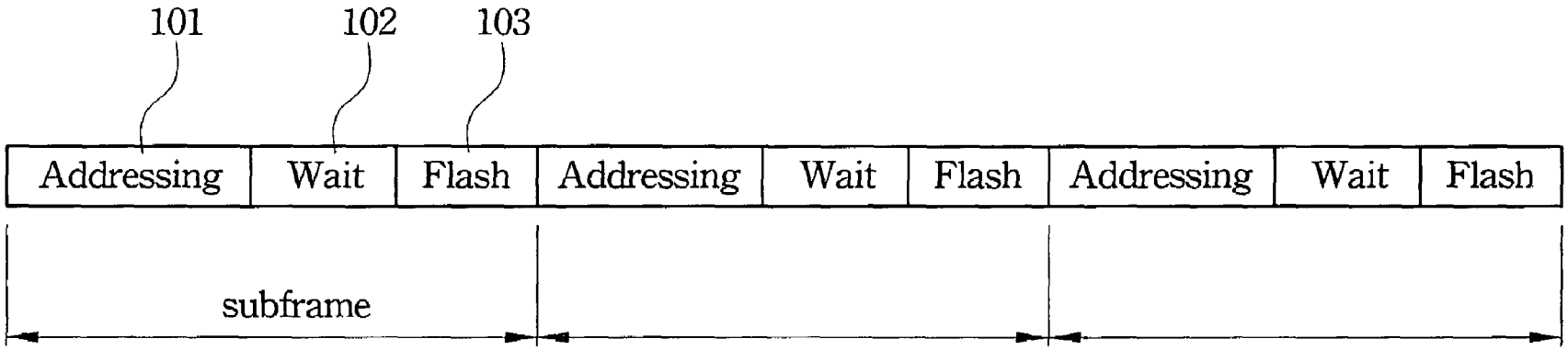
Fig. 1 (Prior Art)
FIG. 1 shows a driving scheme of conventional FS-LCD.
Figure 2:
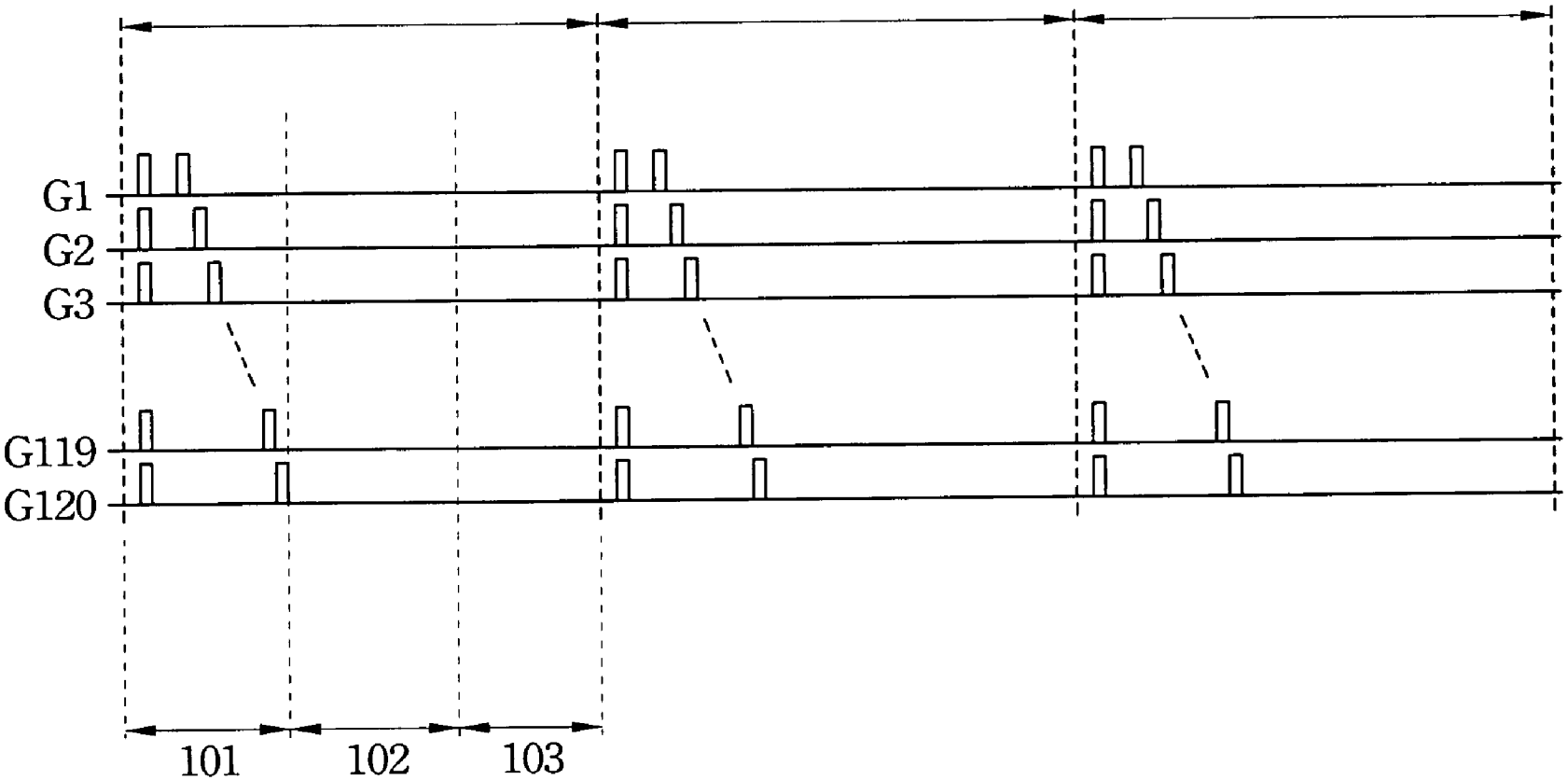
Fig. 2 (Prior Art)
FIG. 2 is a conventional driving scheme.

Reference will now be made in detail to the present preferred embodiments of the invention, examples of which are illustrated in the accompanying drawings. Wherever possible, the same reference numbers are used in the drawings and the description to refer to the same or like parts.

Figure 3:
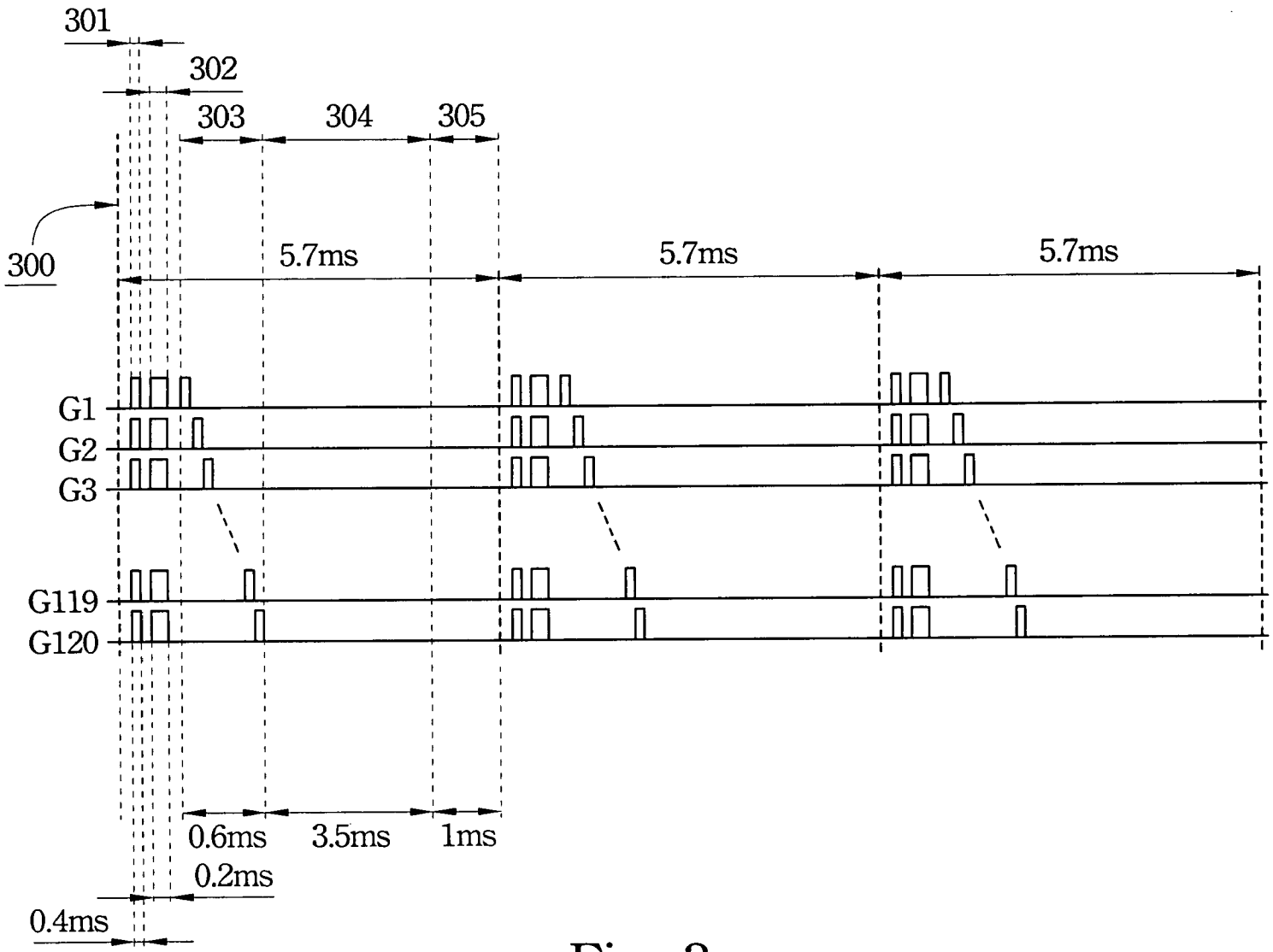
FIG. 3 shows a driving scheme according to one preferred embodiment of this invention.

A driving scheme of a liquid crystal display is divided into several subframes. Referring to FIG. 3, the subframe 300 is a period including five intervals: writing black signals 301, writing white signals 302, writing color signals 303, waiting for the LC response time 304, and turning on light source 305. If writing black signals 301 is about 0.4 ms, writing white signals 302 is about 0.2 ms, writing color signals 303 is about 0.6 ms, waiting for the LC response time 304 is about 3.5 ms, and turning on light source 305 is about 1 ms, the whole subframe is almost about 5.7 ms, i.e. the frame frequency is 60 Hz.

Figure 4:
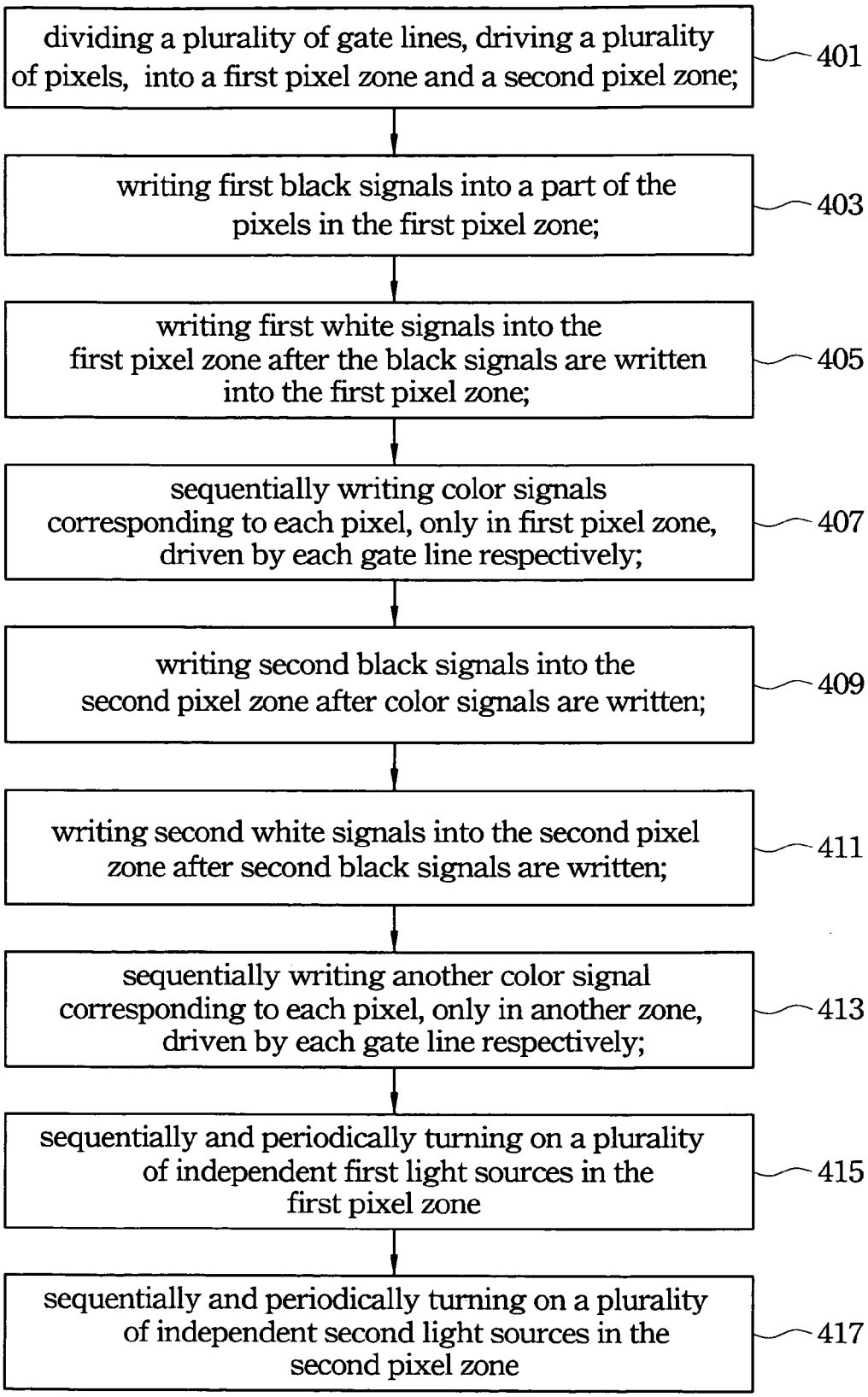
FIG. 4 shows the flow chart according to one preferred embodiment of this invention.
Figure 5:
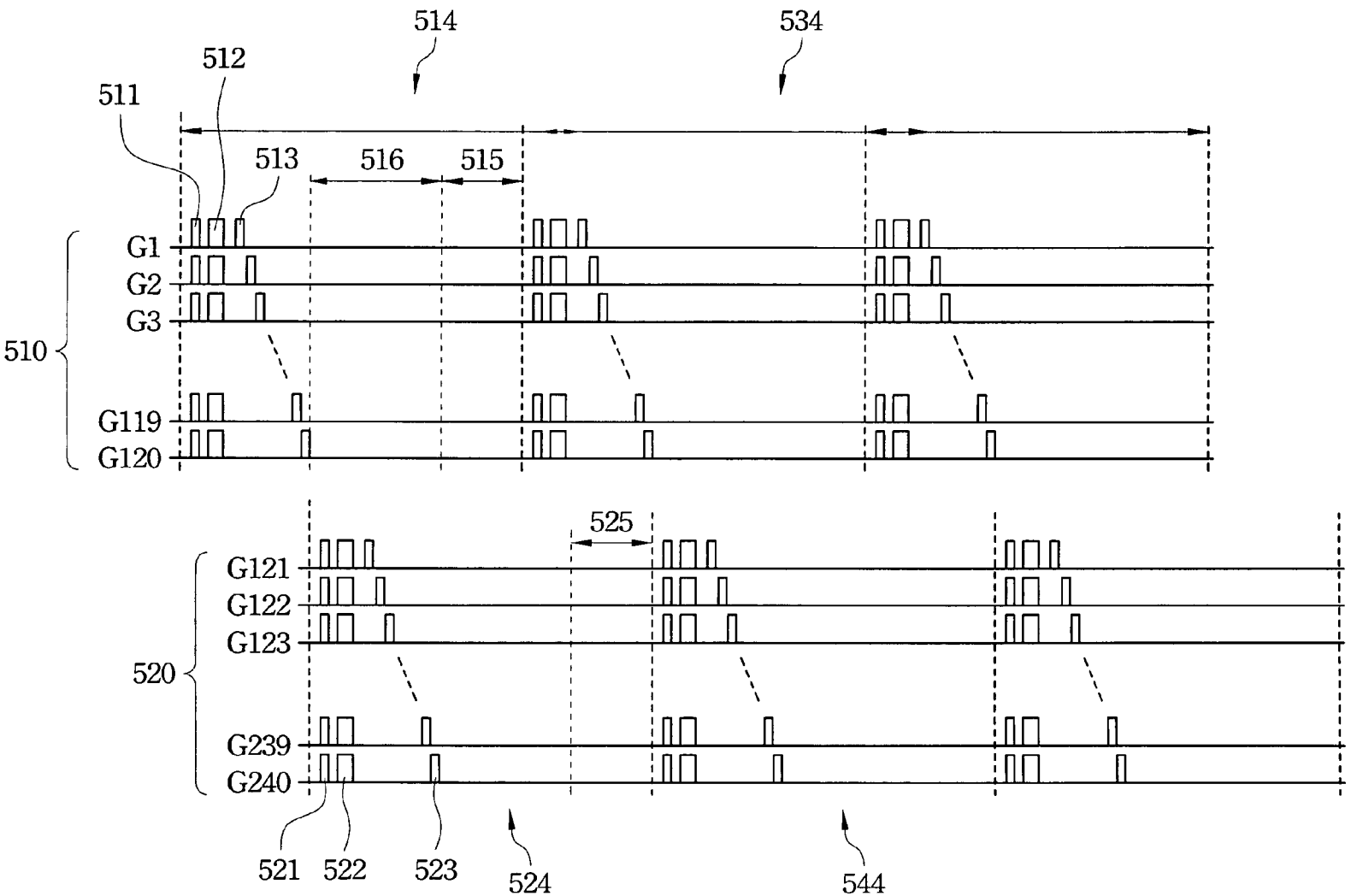
FIG. 5 shows the driving scheme of one embodiment of the invention.

In the FIG. 4, the flow chart of the embodiment is shown. Refer to FIG. 5. FIG. 5 shows the driving scheme of one embodiment of the invention to explain the flow chart in FIG. 4. Although the following description takes two zones for example, it isn't limited to two zones and can be more than two zones. The steps of the method are as follows:

In FIG. 5, the subframe 514 is a period including five intervals: first black signals 511 are written, next white signals 512 are written, then color signals 513 are written, waiting for LC response time 516, and finally the first light source 515 is turned.

Step 401: dividing a plurality of gate lines, driving a plurality of pixels, into a first pixel zone and a second pixel zone. There are 240 gate lines, respectively labeled as G1 to G240, in the liquid crystal, and they are divided into two zones, a first pixel zone 510 (from G1 to G120) and a second pixel zone 520 (from G121 to G240). There are several subframes respectively displayed in the first pixel zone 510 (from G1 to G120) and a second pixel zone 520.

Step 403: writing first black signals into a part of the pixels in the first pixel zone. First black signals 511 are written into pixels in G1-G120 in the first pixel zone 510 at the same time the subframe period 514 begins.

Step 405: writing first white signals into the first pixel zone after the black signals are written into the first pixel zone. After first black signals 511 are written into pixels on G1-G120 in the first pixel zone 510 completely, first white signals 512 are written into pixels on G1-G120 in the first pixel zone 510 at the same time.

Step 407: sequentially writing color signals corresponding to each pixel, only in first pixel zone, driven by each gate line respectively. Each one of the color signals 513 includes a red signal, a green signal and a blue signal is respectively written from G1 to G120 in the first pixel zone 510.

Step 409: writing second black signals into the second pixel zone after color signals are written. Second black signals 521 are written into G121-G240 in the second pixel zone 520 at the same time after color signals 513 are respectively written into pixels on G1-G120 in the first pixel zone 510 completely.

Step 411: writing second white signals into the second pixel zone after second black signals are written. After the second black signals 521 are written into pixels on G121-G240 in the second pixel zone 520 completely, second white signals 521 are written into G121-G240 in the second pixel zone 520 at the same time.

Step 413: sequentially writing another color signal corresponding to each pixel, only in another zone, driven by each gate line respectively. Each one of the other color signals 523 includes red signals, green signals and blue signals are respectively written from G121 to G240 in the second pixel zone 520.

Step 415: sequentially and periodically turning on a plurality of independent first light sources in the first pixel zone. First light sources turn on during the interval 515 at the end of the subframe 514.

Step 417: sequentially and periodically turning on a plurality of independent second light sources in the second pixel zone. Second light turns on at the end of the subframe. Second light sources turn on during the interval 525 at the end of the subframe 524.

The method can apply to all kinds of field sequential driving in the liquid crystal display such as an optical compensated bend mode liquid crystal display. However, in the first pixel zone 510, after the subframe 514 is completed, the next subframe 534 is immediately displayed. Similarly, in the second pixel zone 520, after the subframe 524 is completed, the next subframe 544 is immediately displayed. In conclusion, when one subframe is finished, the next subframe will be displayed. Thus, the lights of three primary colors outputted from R, G, and B light sources are sequentially displayed in a time-divisional manner so that the color images are displayed using an after image effect of the eyes.

Figure 6:
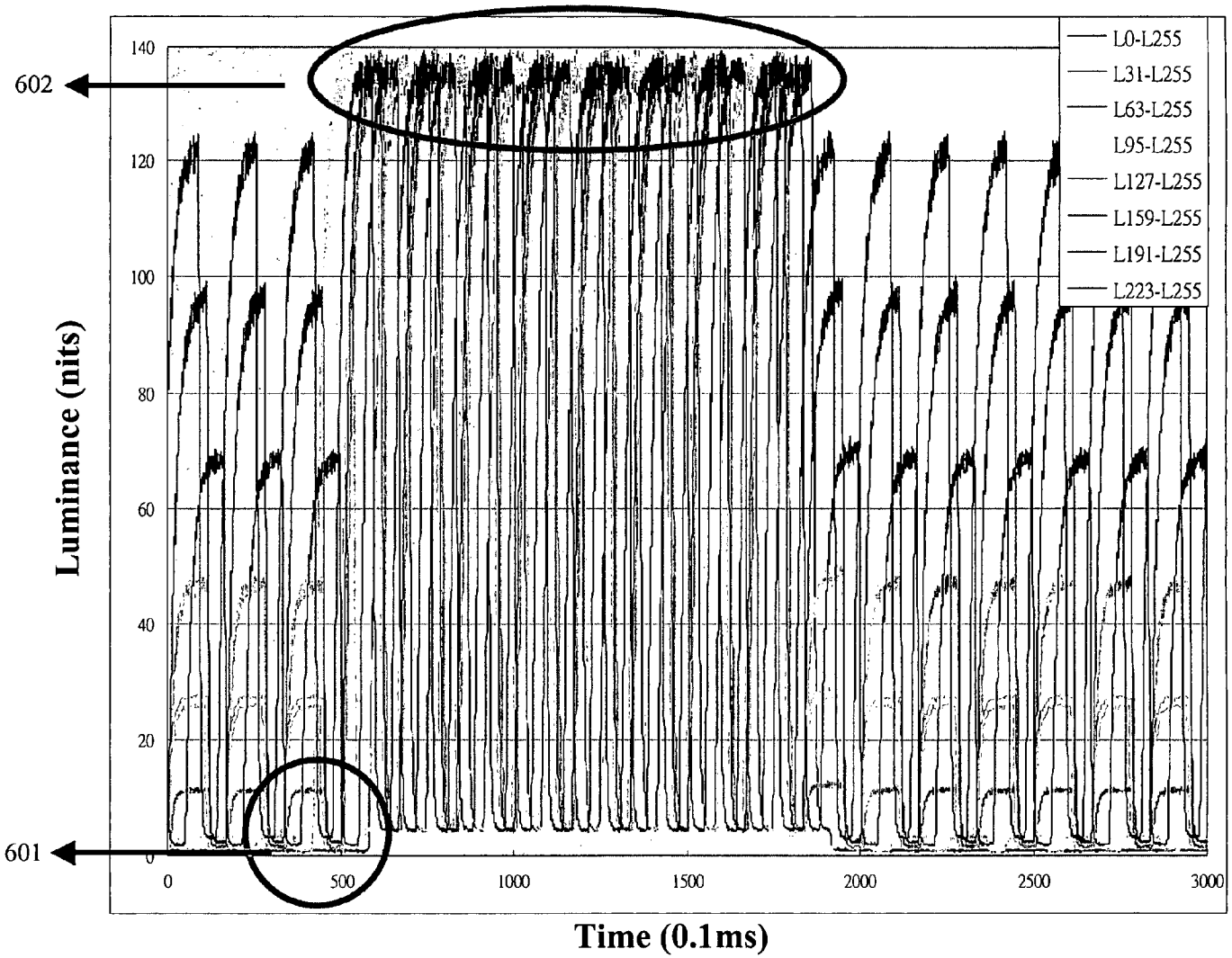
FIG. 6 shows that the changes of luminance after writing black signals.

As described above, black signals are written in the beginning of the subframe period, they are used as reset signals to compensate for the luminance of the liquid crystal display. The evidence is proved in the FIG. 6, after black signals are respectively inserted in to different gray levels of the color signals (as shown in 601), although the luminance of the color signals still have minor differences in the dark state, the luminance of the color signals achieves almost the same in the bright state (as shown in 602). So inserting black signals improves the uniform luminance of the color signals.

Figure 7:
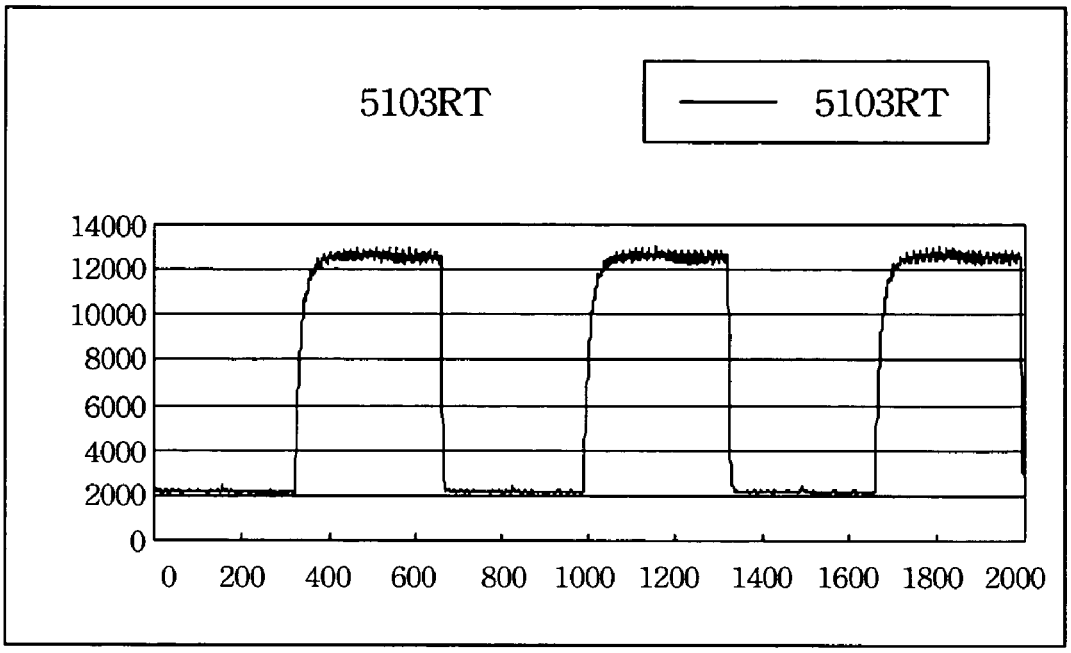
FIG. 7 shows that the changes of luminance after writing white signals.
Figure 7:
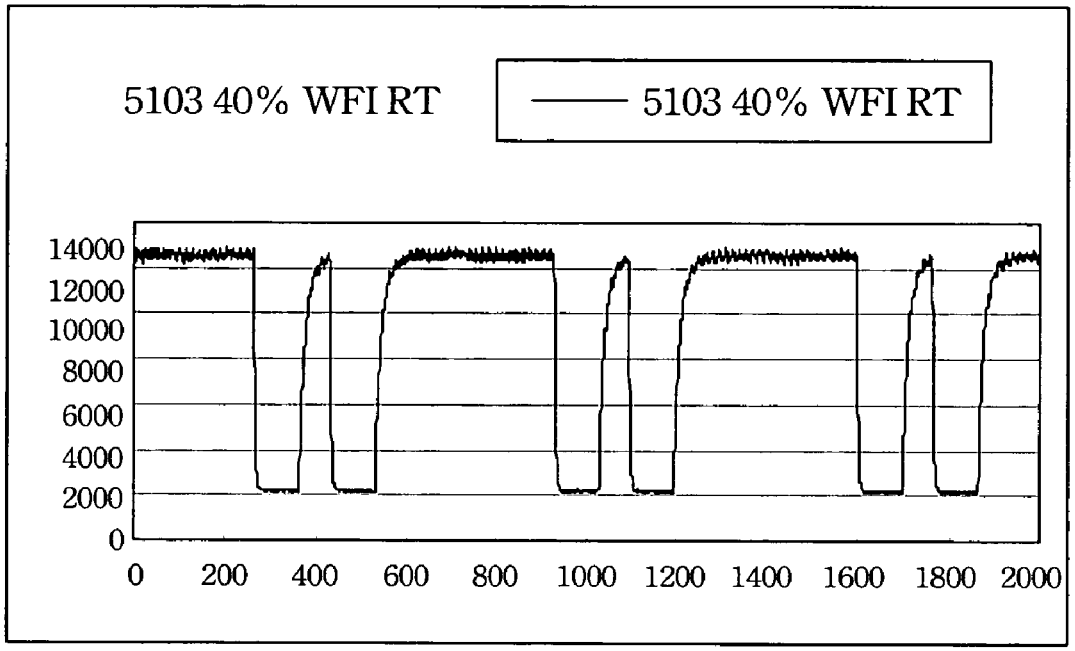

However, the reset time, the interval between inserting the black signals and the luminance reset of the color signals can be zero, increases the period of the subframe. To prevent this, the method needs a shorter response time to compensate the extension. As proved in the FIG. 7, a response time that includes a raising time Tr and a falling time Tf, and Tr+Tf=2.8+0.6=3.4 ms. While after inserting white signals, the response time reduces to Tr'+Tf'=2.5+0.5=3.0 ms. So the process of inserting a signal can reduce the response time.

In conclusion, because scanning from one zone to another zone, the scanning speed can be higher, and thus the method can be applied to a large display. Otherwise, inserting white signals, the method can reduce the response time and gains a longer flashing interval, and thus achieves higher and more uniform luminance. Besides, in an optical compensated bend mode liquid crystal display, because there is a voltage reduction of the liquid crystal cells from a splay state into a bend state, the method can decrease the operating voltage, and then the electrode load and low mobility of the TFT in a panel can be improved.

Although the present invention has been described in considerable detail with reference certain preferred embodiments thereof, other embodiments are possible. Therefore, their spirit and scope of the appended claims should no be limited to the description of the preferred embodiments container herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A field sequential driving method for driving a liquid crystal display, wherein said liquid crystal includes a plurality of gate lines, comprising the steps of:

grouping said gate lines into a plurality of pixel zones, including a first pixel zone to an $N^{th}$ pixel zone;

sequentially addressing the first pixel zone to the Nth pixel zone, wherein addressing each pixel zone comprises:

writing black signals into pixels in the pixel zone;

writing white signals into pixels in the pixel zone after the black signals are written into pixels in the pixel zone;

sequentially writing color signals to corresponding pixels in the pixel zone after the white signals are written into pixels in the pixel zone; and sequentially flashing light source from the first pixel zone to the $N^{th}$ pixel zone.

2. The field sequential liquid for driving a liquid crystal display of claim 1, wherein sequentially flashing light source further comprises sequentially turning on the light sources of a red light source, a green light source and a blue light source.

3. The field sequential liquid for driving a liquid crystal display of claim 1, wherein the color signals includes red color signal, green color signals and blue color signals.

4. The field sequential liquid for driving a liquid crystal display of claim 1, wherein black signals are reset signals for compensating luminance of the liquid crystal display.

5. The field sequential liquid for driving a liquid crystal display of claim 1, wherein the liquid crystal display is an optical compensated bend mode liquid crystal display.

6. The field sequential liquid for driving a liquid crystal display of claim 5, wherein black signals are to decrease critical voltages ($V_{cr}$) of a plurality of liquid crystal cells in an optical compensated bend mode liquid crystal display from a splay into a bend state.

7. A field sequential driving method for driving a liquid crystal display, comprising the steps of:

dividing a plurality of gate lines, driving a plurality of pixels, into a first pixel zone and a second pixel zone;

writing first black signals into a part of the pixels in the first pixel zone;

writing first white signals into the first pixel zone after the black signals are written into the first pixel zone;

sequentially writing color signals corresponding to each pixel after writing the first white signals, only in first pixel zone ,driven by each gate line respectively;

writing second black signals into second pixel zone after color signals are written;

writing second white signals into another part of the pixels in the second pixel zone after second black signals are written;

sequentially writing another synchronized color signals corresponding to each pixel after writing the second white signals, only in another pixel zone ,driven by each gate line respectively;

sequentially and periodically turning on a plurality of independent first light sources in the first pixel zone; and sequentially and periodically turning on a plurality of independent second light sources in the second pixel zone.

8. The field sequential liquid for driving a liquid crystal display of claim 7, wherein the signals includes red color signals, green color signal, and blue color signal.

9. The field sequential liquid for driving a liquid crystal display of claim 7, wherein first black signals and second black signals are reset signals for compensating luminance of the liquid crystal display.

10. The field sequential liquid for driving a liquid crystal display of claim 7, wherein the liquid crystal display is an optical compensated bend mode liquid crystal display.

11. The field sequential liquid for driving a liquid crystal display of claim 10, wherein black signals are to decrease critical voltages of a plurality of liquid crystal cells in an optical compensated bend mode liquid crystal display from a splay into a bend state.

* * * * *